United States Patent [19]

Stephan

[11] 4,020,752

[45] May 3, 1977

[54] AIR DIFFUSER WITH MODULAR CORE

[75] Inventor: Karl Heinz Stephan, Tucson, Ariz.

[73] Assignee: Lear Siegler, Inc., Santa Monica, Calif.

[22] Filed: Oct. 10, 1975

[21] Appl. No.: 621,570

[52] U.S. Cl. ..... 98/40 D; 98/114

[51] Int. Cl.[2] ..... F24F 13/16

[58] Field of Search ..... 98/40 D, 114; 55/509, 55/48 L; 52/475

[56] References Cited

UNITED STATES PATENTS

| | | | |
|---|---|---|---|
| 2,654,451 | 10/1953 | Schmidgall | 52/475 |
| 2,982,197 | 5/1961 | Roberts | 98/40 D |
| 3,948,155 | 4/1976 | Hedrick | 98/40 D |

*Primary Examiner*—William E. Wayner
*Attorney, Agent, or Firm*—Cahill, Sutton & Thomas

[57] ABSTRACT

An air diffuser with a modular core is disclosed in which the diffuser comprises a fixed rectangular framework retaining a plurality of removeable rectangular core elements. The direction and volume of air distributed by the diffuser is selectively changed by adjusting the position of the circulation blades comprising the modular core elements and by altering the orientation of the elements. Each element is retained on two sides by the fixed framework and is secured to the framework by a spring clip located at a corner of the element.

7 Claims, 3 Drawing Figures

AIR DIFFUSER WITH MODULAR CORE

FIELD OF THE INVENTION

This invention relates to air distribution systems and, more particularly, to flow diffusers for selectively varying the flow patterns from an air distribution system outlet.

DESCRIPTION OF THE PRIOR ART

Because the discharge duct of an air distribution system is substantially smaller than the enclosure to which the air is distributed, it is desirable to have some means for dispersing the discharge from the distribution duct to deliver air uniformly throughout the enclosing structure. Early efforts to effect the desired distribution were accomplished by inserting a diffuser or register at the distribution discharge outlet. Examples of such diffusers are shown in U.S. Pat. Nos. 2,282,946 issued May 12, 1942 to W. C. De Roo; 2,285,984 issued June 9, 1942 to A. E. Kietzmann; and 3,170,387 issued Feb. 23, 1965 to J. V. Felter. A singular disadvantage of such diffusers resulted from the fixed position of the elements of the diffuser. No capacity existed for altering the distribution pattern as the demands upon the distribution system changed.

Efforts to overcome the inflexibility of such early diffusers resulted in a diffuser having movable circulation blades. A diffuser having movable circulation blades was effective not only to alter the distribution direction of the circulated air, but was also effective to control the volume flow in a given direction. Examples of such adjustable diffusers are shown in U.S. Pat. Nos. 2,881,689 issued Apr. 14, 1959 to F. D. Stevens; 3,180,246 issued Apr. 27, 1965 to E. H. Johnson; and 3,363,535 issued Jan. 16, 1968 to G. J. Sweeney. Because such circulation blades are pivoted about a single axis, the variations in flow direction are restricted to changes about that axis. It was impossible for these diffusers to distribute air in a direction transverse to the axis of the circulation blades.

Attempts to provide a diffuser having the full flexibility of being able to distribute air in any direction resulted in the development of modular air diffusers. A modular diffuser contains a fixed framework within which individual elements are retained. The elements are shaped to permit placement within the framework of the diffuser in a variety of orientations to give the desired distribution flexibility. Examples of such modular diffusers are shown in U.S. Pat. Nos. 2,909,112 issued Oct. 20, 1959 to H. H. Yousoufian; 3,264,972 issued Aug. 9, 1966 to E. F. Averill, et al.; and 3,327,607 issued June 27, 1967 to J. F. Newell, et al. Although each of the disclosed diffusers included a modular element that could be positioned in a variety of orientations, none of these devices included adjustable circulation blades to permit the volume of circulation to be selectively varied.

In U.S. Pat. No. 2,982,197 issued May 2, 1961 to J. A. Roberts a modular air diffuser was disclosed in which each modular element within the diffuser included a plurality of adjustable circulation blades so that not only could the flow direction be determined by selectively orienting the module within the diffuser, but also the circulation volume emanating from an individual module could be determined by the position of the circulation blades comprising that module. Although the Roberts' diffuser effectively distributed air within the enclosure, it was an involved procedure to alter the orientation of the individual modules comprising the diffuser. Since the modules were retained in the diffuser framework by a long bolt extending completely through the throat of the diffuser, it was necessary to remove the diffuser from the air discharge duct in order to remove the retaining bolt, reorient desired modules, then resecure the modules to the diffuser framework by reinserting the retaining bolt. Following the reassembly of the diffuser, it could be then reinstalled in the air discharge duct.

SUMMARY OF THE INVENTION

In one illustrative embodiment of my invention, an air distribution diffuser is disclosed, comprising a rectangular framework having four square modular core elements. The elements can be retained within the framework in a variety of orientations to distribute air in any direction and volume desired. Two adjacent sides of each element are supported by the framework and the element is then secured to the framework by a clip located diagonally opposite the corner between the adjacent sides. The element can be removed from the framework by removing the clip. After being reoriented in the desired direction, the element may be reinstalled in the framework by reinserting the clip. Each element includes a plurality of blades to permit the outlet area to be adjusted, thereby obtaining the desired flow from each individual element.

It is an object of my invention to permit adjustment of the flow direction from a diffuser along mutually perpendicular axes.

It is another object of my invention to provide an air diffuser having modular core elements for distributing the flow from the diffuser.

It is also an object of my invention to permit adjustable flow from each modular element of the flow diffuser.

It is still a further object of my invention to permit the orientation of core modules within a flow diffuser to be readily altered without removing the diffuser from a discharge duct.

BRIEF DESCRIPTION OF THE ILLUSTRATIVE EMBODIMENT

In order to facilitate the explanation of the advantages and mechanical features of my invention, an embodiment in which a perforated plate diffuser provides the termination for an air discharge duct will be described. A perforated plate diffuser would commonly be used in a commercial building, particularly of the type having a so-called "dropped" or suspended ceiling. In such installations, the visible ceiling of an office may be several feet below the structural ceiling of the building. In the space between the visible ceiling and the actual structural ceiling, a labyrinth of plumbing, electrical wiring, telephone cables, and air distribution systems are confined. The circulation duct would go to the individual offices within the structure where the circulating air is distributed to the offices. At the visible ceiling line of the offices, strategically placed perforated grilles are located to give an innocuous aesthetic appearance to the outlet of the circulation system, while diffusing the discharge from the duct system to permit the air to flow uniformly throughout the room as unobtrusively as possible.

Figure 1:
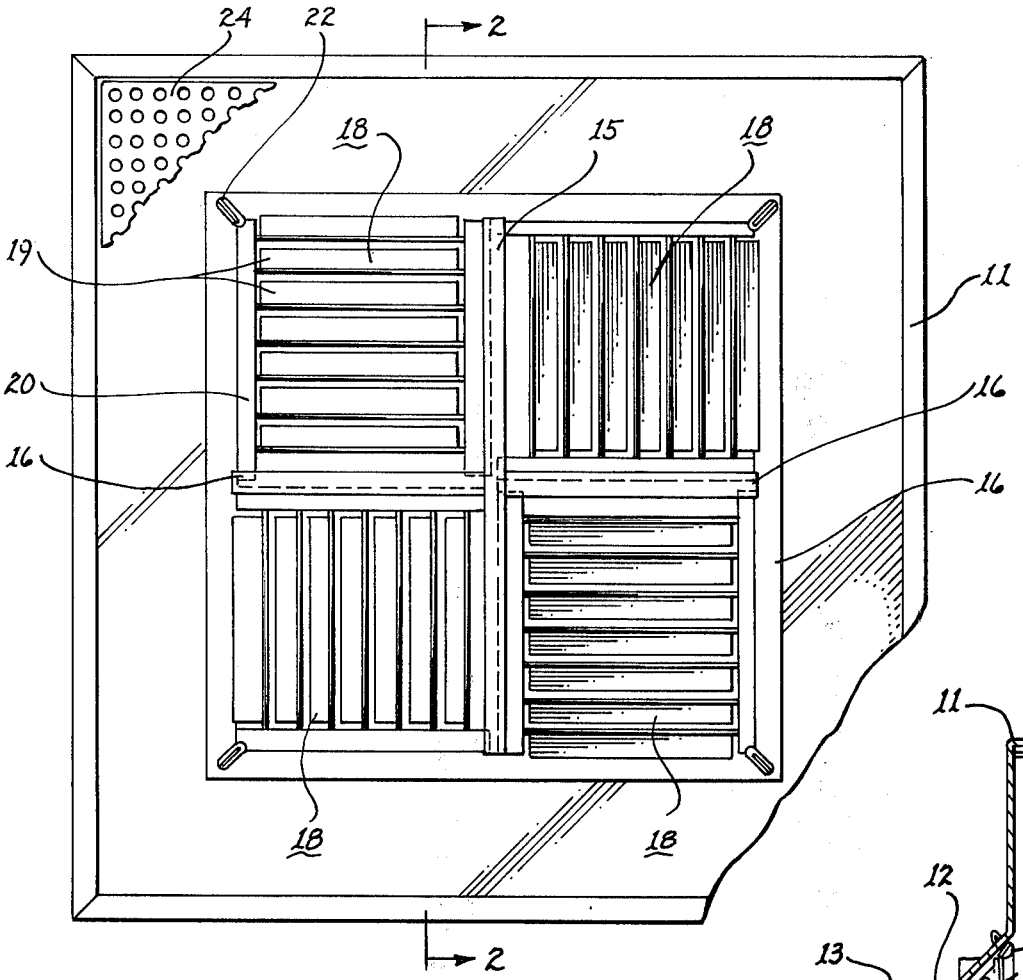
FIG. 1 is a plan view of an air diffuser embodying my invention.
Figure 2:
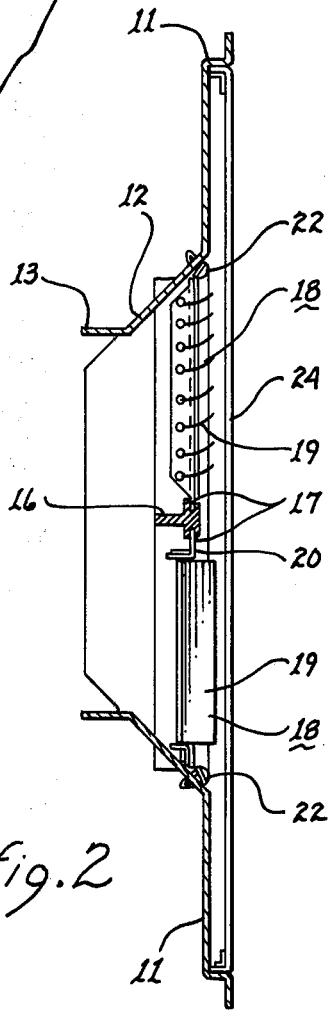
FIG. 2 is a cross-sectional view of the diffuser of FIG. 1 taken along line indicated.

The perforated plate diffuser shown in FIG. 1 includes a framework 11 which is permanently mounted into the ceiling suspension system. Across the face of framework 11 is a perforated grill 24 secured to framework 11. As shown in FIG. 2, extending backward from the framework 11 is a tapering throat section 12, which terminates in a flange 13. Flange 13 connects to the distribution duct of the air circulation system. Air which is discharged from the circulation duct will enter the diffuser through flange 13 for eventual distribution through the perforated grill 24.

Rather then merely having the air exit from the diffuser at a random pattern, it is desirable to have the ability to control the direction and volume of the circulating air being discharged from the diffuser. For this reason, a circulation core is located in the throat area of the diffuser. The core of the diffuser shown in FIG. 1 is made up of four identical modular core units 18. One of the modular core elements 18 is shown in more detail in FIG. 3. Element 18 includes a pluraltiy of adjustable blades 19 secured within a core housing 20. Blades 19 are free to pivot about their longitudinal axis. As is clearly shown in FIG. 2, blades 19 can be individually positioned so that moderate flexibility is obtained in selecting the direction of discharge flow from element 18. Complete flexibility can be exercised in determining the volume of flow passing through the element. It is possible to close down all of blades 19 within an element 18 so that virtually no air flow will pass through that element, or fully open all the blades to permit the maximum flow, or utilize some intermediate position.

Figure 3:
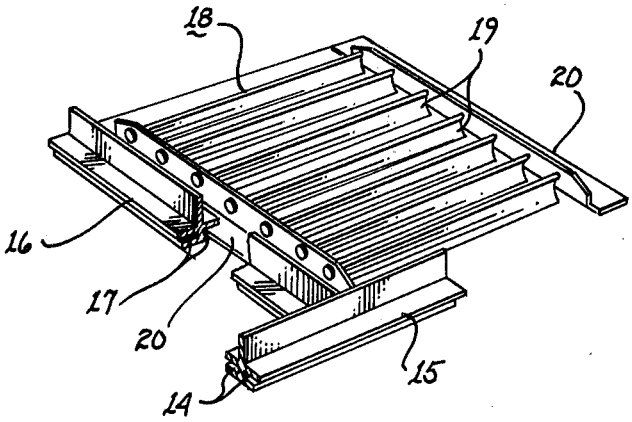
FIG. 3 is a perspective view of one element of the diffuser shown in FIG. 1.

Throat 12 of the diffuser is divided into a number of openings as shown in FIG. 1. The area of throat 12 is divided by a T-strut 15 extending across the throat and by T-braces 16 extending perpendicular to the strut and across throat 12. Strut 15 and braces 16 have similar cross-sectional shapes, as shown in FIGS. 2 and 3. The somewhat T-shaped cross-section of strut 15 and braces 16 respectively include oppositely facing slots 14 and 17 which are adapted to engage housing 20 of element 18. As can be seen in FIG. 1, element 18 is positioned in the diffuser so that one edge of housing 20 is confined within slot 14 of strut 15 and an adjacent side of housing 20 is engaged by slot 17 in brace 16. The corner of housing 20 located opposite the corner between the two adjacent sides is then secured into throat 12 by a retainer clip 22 which is inserted through the throat.

Although it is desirable to be able to change the distribution pattern of the diffuser after it has been installed in the air circulation system, it is very disadvantageous to disturb the connection between flange 13 and the distribution duct or to disturb the connection between frame 11 and the ceiling suspension system. For this reason, a diffuser in accordance with my present invention is designed for permanent connections at both those points. In order to alter the flow pattern of the diffuser, it is necessary merely to remove perforated grill 24 to obtain access to core elements 18. Any of the core elements may then have appropriate adjustments made in the volume of flow passing through each by adjusting the appropriate blades 19 in the individual elements 18. In addition, the direction of flow leaving an element 18 may be selectively altered. For example, core element 18′ appearing at the upper left of FIG. 1 may be removed completely by removing retainer clip 22 and withdrawing the element from its engagement with strut 15 and braces 16. Once it has been removed, core element 18′ may be reoriented in any desired position and then reinserted into the opening in the diffuser by reinserting two edges of housing 20 in slots 14 in strut 15 and slots 17 in brace 16 and retaining the opposite corner of the frame into throat area 12 with retainer clip 22. Grill 24 could then be reinstalled in frame 11. This adjustment process could be undertaken as often as required in order to obtain the desired distribution from the diffuser or as the uses of the room in which the diffuser is located are changed.

It should be apparent that other modifications and alterations could be made by those skilled in the art without departing from the spirit and scope of my invention. For example, the elements 18 have been disclosed as being substantially square in their overall configuration. Numerous applications would exist where element 18 would advantageously have a rectangular shape other than square. Similarly, it has been indicated that the throat area 12 is divided into four substantially square openings. In many applications, there would be more or less than four such openings, and in many of those applications the shape of the opening would advantageously be a rectangular shape other than square.

What I claim is:

1. Apparatus for diffusing the air flow from an air distribution duct, said apparatus comprising, in combination:

a. a rectangular framework connectable to the outlet of the air distribution duct;

b. a plurality of support strips for dividing said framework into a plurality of modular rectangular openings;

c. a plurality of modular rectangular core elements for insertion into the openings, each of said elements being insertable into the openings in a plurality of orientations and being supported by at least one of said support strips upon being inserted into the openings; and d. a plurality of securing means each positioned at a corner of a different one of each of said elements opposite the supporting strip supporting said element, each securing means engaging said element and releasably supporting a corner of said element.

2. Apparatus for diffusing the air flow from an air distribution duct, said apparatus comprising, in combination:

a. a rectangular framework connectable to the outlet of the air distribution duct;

b. a plurality of support strips for dividing said framework into a plurality of modular rectangular openings;

c. a plurality of modular rectangular core elements for insertion into the openings, each of said elements being insertable into the openings in a plurality of orientations and being supported by at least one of said support strips upon being inserted into the openings;

d. securing means for securing each said element to said framework by engaging said element;

e. each of said elements being supported on two adjacent sides and engaged by said securing means at the corner of said element opposite the corner included between the adjacent sides.

3. Apparatus in accordance with claim 2, wherein each of said elements includes a plurality of movable blades extending across said core for adjusting the volume and direction of flow passing through said element.

4. Apparatus in accordance with claim 2, wherein each of said elements includes a square housing for supporting said blades.

5. Apparatus for diffusing the air flow from an air distribution duct, said apparatus comprising, in combination:

a. a rectangular framework connectable to the outlet of the air distribution duct;

b. a plurality of support strips having a pair of oppositely facing slots extending the length of said strip, said support strips connecting to said framework to position the slots in a plane parallel to the plane of the framework and to divide said framework into a plurality of modular rectangular openings;

c. a plurality of modular rectangular core elements for selectively controlling the volume and direction of air flowing from the air distribution duct, each of said elements being insertable into said slots to be supported within an opening by at least one of said strips, said elements each including i. a housing; and ii. a plurality of movable blades mounted parallel to each other in said housing and extending thereacross for controlling the direction and volume of air flowing through said element;

d. securing means for securing each of said elements to said framework by engaging the housings of said elements;

e. said securing means including a clip insertable into said framework and retained thereby for engaging the corner of said housing opposite the corner between the adjacent sides.

6. Apparatus in accordance with claim 5, wherein each said element is square and is supported at two adjacent sides by said strips.

7. Apparatus in accordance with claim 5, wherein said strips have a substantially T-shaped cross-sectional configuration and are oriented in mutually perpendicular relationship to each other.

* * * * *